US006844122B2

(12) United States Patent
Haggquist

(10) Patent No.: US 6,844,122 B2
(45) Date of Patent: Jan. 18, 2005

(54) XEROGRAPHIC METHOD FOR COATING A MATERIAL WITH SOLID PARTICLES

(75) Inventor: Gregory W. Haggquist, Longmont, CO (US)

(73) Assignee: TrapTek LLC, Longmont, CO (US)

( * ) Notice: Subject to any disclaimer, the term of this patent is extended or adjusted under 35 U.S.C. 154(b) by 73 days.

(21) Appl. No.: 10/184,447

(22) Filed: Jun. 26, 2002

(65) Prior Publication Data

US 2002/0197547 A1 Dec. 26, 2002

Related U.S. Application Data

(60) Provisional application No. 60/300,917, filed on Jun. 26, 2001.

(51) Int. Cl.[7] ..... G03C 3/00
(52) U.S. Cl. ..... 430/18; 430/108.1
(58) Field of Search ..... 430/18, 108.1

(56) References Cited

U.S. PATENT DOCUMENTS

| | | | | |
|---|---|---|---|---|
| 3,783,085 A | | 1/1974 | Pearson et al. | 161/87 |
| 4,004,324 A | | 1/1977 | Bridge et al. | 19/156.3 |
| 4,099,186 A | * | 7/1978 | Edwards et al. | 346/74.7 |
| 4,244,059 A | | 1/1981 | Pflaumer | 2/400 |
| 4,342,811 A | | 8/1982 | Lopatin et al. | 428/220 |
| 4,396,663 A | | 8/1983 | Mitchell et al. | 428/111 |
| 4,455,187 A | | 6/1984 | von Blücher et al. | 156/277 |
| 4,457,345 A | | 7/1984 | von Blücher et al. | 139/420 R |
| 4,496,415 A | | 1/1985 | Sprengling | 156/283 |
| 4,510,193 A | | 4/1985 | Blücher et al. | 428/196 |
| 4,551,191 A | | 11/1985 | Kock et al. | 156/276 |
| 4,610,905 A | | 9/1986 | von Blücher et al. | 428/90 |
| 4,698,956 A | | 10/1987 | Clarke et al. | 57/2 |
| 5,037,412 A | | 8/1991 | Tanzer et al. | 604/359 |
| 5,281,437 A | | 1/1994 | Singh | 427/180 |
| 5,300,192 A | | 4/1994 | Hansen et al. | 162/184 |
| 5,308,896 A | | 5/1994 | Hansen et al. | 524/13 |
| 5,334,414 A | | 8/1994 | Edie et al. | 427/189 |
| 5,334,436 A | | 8/1994 | Hobbs et al. | 428/195 |
| 5,338,340 A | | 8/1994 | Kasmark, Jr. et al. | 96/135 |
| 5,342,333 A | | 8/1994 | Tanzer et al. | 604/359 |
| 5,352,480 A | | 10/1994 | Hansen et al. | 427/202 |
| 5,364,380 A | | 11/1994 | Tanzer et al. | 604/359 |

(List continued on next page.)

FOREIGN PATENT DOCUMENTS

| | | | |
|---|---|---|---|
| DE | 4008519 A1 | 9/1990 | G03G/15/08 |
| EP | 0 962 831 A1 | 12/1999 | G03G/9/087 |
| GB | 2238802 A | 6/1991 | B01D/39/14 |
| WO | WO 89/12552 | 12/1989 | B41J/3/18 |
| WO | WO 98/42909 | 10/1998 | D06M/11/00 |
| WO | WO 01/05583 A1 | 1/2001 | B32B/5/12 |
| WO | WO 01/18305 A1 | 3/2001 | D06M/15/263 |

OTHER PUBLICATIONS

Myron J. Copeland and George Lopatin, "Preparation of Activated Carbon–Filled Micro–porous Hollow Multifilament—A Summary Report," Report Number NATICK TR–78/036, National Technical Information Service, U.S. Department of Commerce, Nov. 1978.

*Primary Examiner*—Mark A. Chapman
(74) *Attorney, Agent, or Firm*—Fish & Neave LLP; Andrew Van Court

(57) ABSTRACT

The present invention relates to methods for imprinting solid particles onto materials that enhance the performance characteristics, such as the odor adsorption capacity, of the material. The present invention uses a xerographic imprinting method to apply a toner formulation to the material. The toner formulation typically includes solid particles (e.g., activated carbon), binding agents, and additives. Using this method, a specific pattern can be imprinted onto the material. The present invention can also use a Gravure method to imprint performance enhancing solid particles onto a material. This method advantageously provides precise control over the volume of mixture (e.g., solid particles and binding agent) impressed onto the material. In addition, this method can imprint specific patterns of mixture onto the material.

15 Claims, 2 Drawing Sheets

U.S. PATENT DOCUMENTS

| | | | | |
|---|---|---|---|---|
| 5,383,236 | A | 1/1995 | Sesselmann | 2/243.1 |
| 5,432,000 | A | 7/1995 | Young et al. | 428/372 |
| 5,447,977 | A | 9/1995 | Hansen et al. | 524/13 |
| 5,462,538 | A | 10/1995 | Korpman | 604/372 |
| 5,498,478 | A | 3/1996 | Hansen et al. | 428/372 |
| 5,538,783 | A | 7/1996 | Hansen et al. | 428/283 |
| 5,539,930 | A | 7/1996 | Sesselmann | 2/243.1 |
| 5,571,618 | A | 11/1996 | Hansen et al. | 428/359 |
| 5,582,644 | A | 12/1996 | Gaddis et al. | 118/303 |
| 5,589,256 | A | 12/1996 | Hansen et al. | 428/283 |
| 5,591,146 | A | 1/1997 | Hasse | 604/359 |
| 5,609,727 | A | 3/1997 | Hansen et al. | 162/184 |
| 5,614,570 | A | 3/1997 | Hansen et al. | 524/13 |
| 5,681,305 | A | 10/1997 | Korpman | 604/390 |
| 5,709,910 | A | 1/1998 | Argyle et al. | 427/434.2 |
| 5,790,987 | A | 8/1998 | Sesselmann | 2/243.1 |
| 5,863,305 | A | 1/1999 | Beardsley et al. | 51/294 |
| 5,885,681 | A | 3/1999 | Korpman | 428/68 |
| 5,951,534 | A | 9/1999 | Cummings et al. | 604/359 |
| 6,007,590 | A | 12/1999 | Sanders, Jr. | 51/295 |
| 6,009,559 | A | 1/2000 | Sesselmann | 2/243.1 |
| 6,017,831 | A | 1/2000 | Beardsley et al. | 442/68 |
| 6,057,072 | A | 5/2000 | Guistina et al. | 430/106 |
| 6,134,718 | A | 10/2000 | Sesselmann | 2/243.1 |
| 6,207,255 | B1 | 3/2001 | Fukuura et al. | 428/175 |

* cited by examiner

XEROGRAPHIC METHOD FOR COATING A MATERIAL WITH SOLID PARTICLES

CROSS-REFERENCE TO A RELATED PATENT APPLICATION

This application claims the benefit of U.S. Provisional Application No. 60/300,917, filed Jun. 26, 2001, the disclosure of which is hereby incorporated by reference in its entirety.

TECHNICAL FIELD OF THE INVENTION

The present invention relates to materials, including fibers, yarns, knitted fabrics, woven fabrics, and non-woven fabrics, that are coated with solid particles. The present invention also relates to processes for coating the surface of a material with solid particles using a xerographic printing method. The present invention also relates to processes for coating the surface of a material with a modified toner formulation comprising the solid particles. The solid particles, such as activated carbon, add performance properties to the material, including odor adsorption, moisture management and/or ultraviolet light protection.

BACKGROUND OF THE INVENTION

It is well known that various materials such as fabrics, clothing, and other apparel can be treated to enhance the performance characteristics associated with the material. The performance characteristics can include, for example, odor adsorption, moisture control, ultra-violet light protection, and/or protection from external elements. Sportswear fabrics such as CoolMax™, HydroMove™, Dry-Fit™, and Dry-Tech™, are examples of fabrics that manage moisture and/or add ultra-violet light protection. Other examples of performance enhanced apparel includes odor adsorbing hunting suits. Such hunting suits may adsorb odors (e.g., caused by perspiration) and allows a hunter to approach wild game without the hunter's scent being detected. Military apparel made from a high performance fabric protects soldiers from chemical and biological weapons.

Certain materials naturally exhibit certain performance characteristics without being treated with chemicals or additives. For example, apparel constructed from an untreated material such as Lycra™ exhibits a moisture management characteristic. Materials such as Lycra™, however, may not exhibit any other characteristics such as odor adsorption and/or ultra-violet protection. In addition, apparel constructed from untreated materials are limited to the physical properties (e.g., texture, feel, durability, etc.) associated with that untreated material. Moreover, the performance characteristics of such materials are often limited and do not adequately enhance the material.

The materials used for producing the above-mentioned apparel may be enhanced using a variety of different methods. For example, one method can include applying chemicals such as Scotchgard™ to impart the desired performance characteristics on the material. After the chemicals are applied, however, the chemicals often dissipate and have to be reapplied continuously throughout the life of the fabric to impart the desired characteristics. The chemicals may dissipate, for example, when the treated fabric is washed or exposed to external elements.

Approaches have been attempted to bind solid particles such as activated carbon to materials (e.g., fibers, yarns, knitted fabrics, woven fabrics, and non-woven fabrics). Activated carbon is a granular substance that varies in size and shape depending on the process used to create the activated carbon. The activated carbon's surface area is covered with pores that also vary in size and shape depending on how it is produced. These pores provide the activated carbon with properties such as odor adsorption.

Although there are known methods of impregnating materials with solid particles, none of these methods have been applied successfully to produce a yarn, a knitted, or woven material with incorporated solid particles, or to produce such a material suitable for garment manufacture. The methods for impregnating materials with solid particles have not been successfully used with woven materials for the following reasons.

First, many methods, such as liquid dispersion or suspension methods, result in encapsulation and consequent deactivation of the solid particles. Such processes have the same disadvantages if practiced on woven materials and yarns.

Second, methods involving tackifying or plasticizing a material (e.g., fabric) to facilitate impregnation with solid particles result in materials that take on the properties of the binding agent and solid particles rather than the material. Such processes have the same disadvantages if practiced on woven or non-woven materials. Furthermore, tackifying or plasticizing ruins the natural substance of the material, resulting in an undesirable or unusable material.

An alternative to impregnating a material such as fabric with solid particles is to form a laminate of the solid particles between two sheets of non-woven or woven cloth. In one prior art method, solid particles are applied to one of the woven sheets as a free flowing powder before the two woven sheets are laminated. This method, however, does not firmly bind the solid particles to the woven sheets. Consequently, the solid particles can shake out of the laminate during, for example, normal washing of the material. Furthermore, this method can only be applied in cases where the outer sheets have pores that are much smaller than the mean size of the solid particles. As a result, this method typically requires the use of granular materials rather than powders.

The known methods are not able to incorporate and bind solid particles to the material with a high degree of precision. Rather, the solid particles are incorporated into the material by randomly dispensing them onto the material.

It is therefore an object of the present invention to permanently attach solid particles to a material using a xerographic method.

It is also an object of the present invention to use a Gravure method to permanently attach the solid particles to a material.

SUMMARY OF THE INVENTION

These and other objects of the present invention are accomplished by providing methods for coating a material with solid particles that enhance the performance characteristics of the material. The solid particles can impart performance characteristics such as trapping odors, moving moisture, trapping chemical agents, providing ultra-violet light protection, and protection from other elements. The solid particles can also provide enhanced wicking properties, chemo-protective properties, fire retardance, antibacterial, antiviral, antifungal, and/or antimicrobial characteristics.

One embodiment of the present invention uses a xerographic method to coat materials such as fibers, yarns, knitted fabrics, woven fabrics, and non-woven fabrics. The xerographic method uses the principles of electrostatic or magnetic attraction to transfer a toner formulation from a hopper to a drum assembly. The toner formulation includes, but is not limited to, solid particles (e.g., activated carbon), binding agents, and additives such as charge control particles, magnetic control particles, and/or coloring agents. The drum assembly is an electrically charged or magnetically polarized assembly that rotates at a predetermined speed. As the drum assembly rotates, the toner formulation is attracted to and retained by selective portions of the assembly. Then, as the assembly continues to rotate, it impresses the toner formulation onto the material.

One advantage of the present invention is that specific patterns of toner formulation can be transferred to the drum assembly, which is then imprinted on the material accordingly. For example, the pattern can include a complex spatial pattern such as graphics, text, logos, etc. This level of control also enables the present invention to imprint toner formulation in an ON/OFF fashion. That is, the toner formulation may be imprinted onto the material for a predetermined period of time, then no toner is imprinted for a predetermined period of time, and then the toner can be reapplied for a predetermined period of time. If desired, the xerographic method can be used to apply the toner formulation in a continuous, square-like manner.

After the toner formulation is imprinted onto the material, the material is subjected to an elevated temperature that causes the binding agent to permanently bind the solid particles to the material. Once the solid particles are fused to the material, the performance characteristics of that material are enhanced. The binding agent can be set, for example, by passing the imprinted material through a pair of heated drums or an oven.

Another embodiment of the present invention implements a Gravure method to imprint a mixture of solid particles and binding agents onto a material. Using this method, the mixture can be applied to a roller having a pattern etched therein. As the roller rotates, a device such as a doctor blade limits the volume of the mixture retained by the roller, thereby controlling the volume of mixture imprinted onto the material. The mixture retained by the roller is impressed onto the material when it comes into contact with the roller. After the mixture is impressed onto the material, the material is subjected to an elevated temperature that causes the binding agents to permanently bind the performance enhancing solid particles to the material.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION APPLICATION

Figure 1:
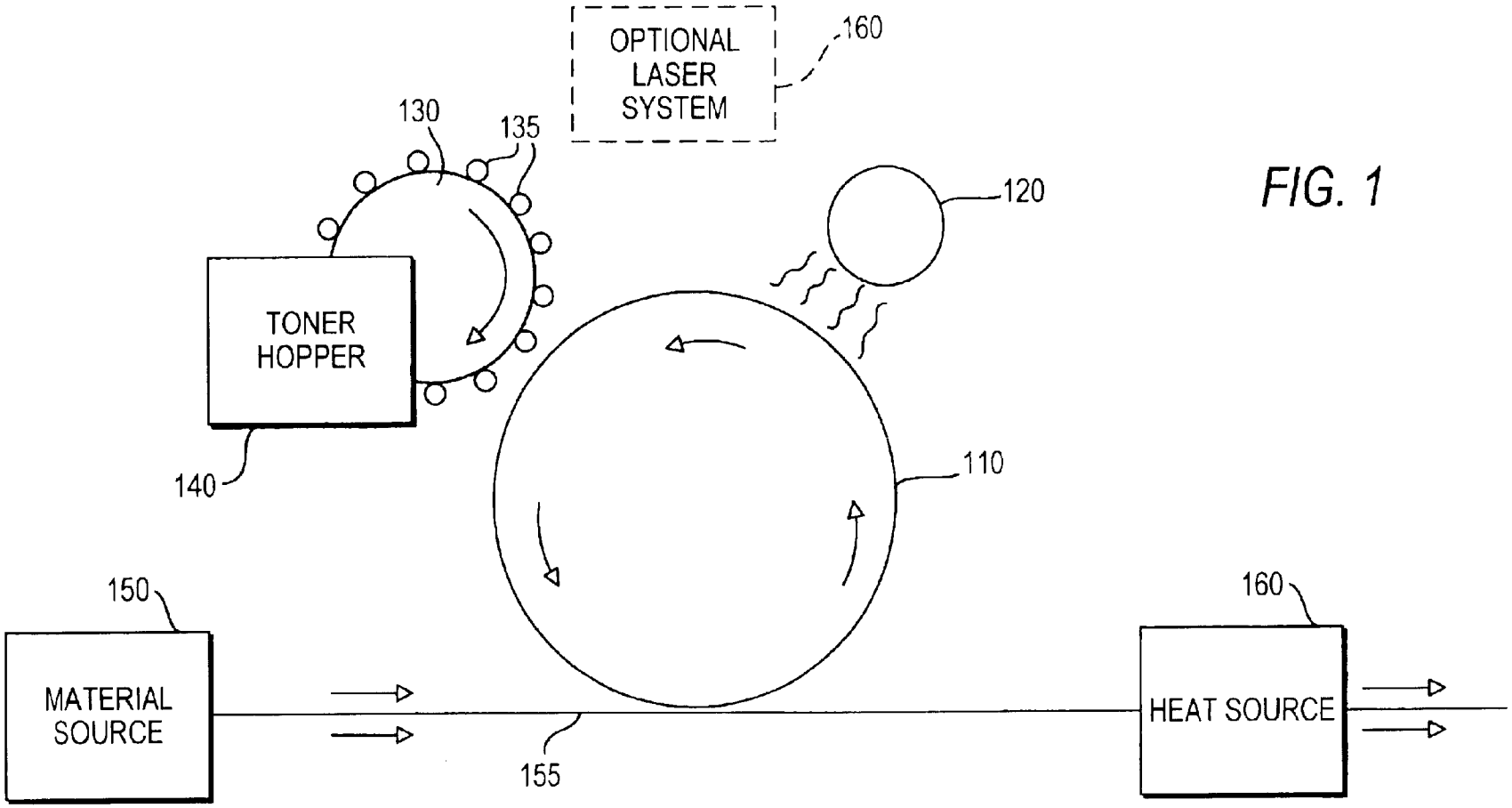
FIG. 1 shows an illustrative xerographic system for implementing a xerographic imprinting method for embedding performance enhancing particles into a material in accordance with the principles of the present invention.

The present invention relates to methods for imprinting solid particles into a material such as fiber, yarn, knitted fabric, woven fabric, and non-woven fabric. Solid particles are imprinted into materials to enhance the performance characteristics of the material. The solid particles may impart performance characteristics such as odor adsorption, moisture management, chemical agent protection, ultraviolet light protection, and protection from other elements. The solid particles can also provide performance characteristics such as enhanced wickability, chemo-protective properties, fire retardance, antibacterial, antiviral, antifungal, and/or antimicrobial protection.

The solid particles include, but are not limited to, activated carbon, graphite, aluminum oxide (activated alumina), silica gel, soda ash, aluminum trihydrate, baking soda, p-methoxy-2-ethoxyethyl ester Cinnamic acid (cinoxate), zinc oxide, zealites, areogels, and titanium dioxide.

The size of the solid particles used for treating yarn varies by available manufacturing processes. The size of the solid particles affects the texture (e.g., coarseness) of the treated yarn. Thus, when a yarn having small solid particles is embedded into a material, it may have a softer feel than a material woven from yarn treated with larger particles. Using smaller particles, however, typically results in higher material cost. In one embodiment of the present invention, the size of the solid particles may range from about 1 $\mu$m to about 200 $\mu$m. In a preferable embodiment, the size of the solid particles can range from about 0.1 $\mu$m to about 10 $\mu$m. In another embodiment, the solid particle size can range from about 1 $\mu$m to about 5 $\mu$m. Persons skilled in the art will appreciate that the size of the solid particles can vary from the above-described ranges. For example, as techniques and processes improve for producing smaller solid particles, it should noted that such smaller particles can be used in the present invention. For example, the solid particle size could range from about 10 nm to about 200 $\mu$m.

The present invention can also imprint binding agents onto the material in combination with the solid particles in accordance with the imprinting methods of the present invention. A binding agent may be used to fix or fuse the solid particles to the material. Such binding agents may be natural or synthetic latexes. Suitable binding agents for use in the process of the present invention include, for example, natural rubber latex, NEOPRENE, styrene butadiene, acrylic/acrylonitrile copolymer, modified n-butyl acrylonitrile copolymer, acrylonitrile polyvinyl acetate, polyacrylate, acrylonitrile butadiene, acrylic methyl methacrylate, self cross linking copolymers of vinyl acetate and ethylene, polystyrenes, polyesters, polyvinyl alcohol, polyvinyl acetate, vinyl chloride copolymers, melamine-formaldehyde resins, starches, carboxymethyl cellulose, methyl cellulose, sodium silicate, and siloxanes, including functionalized siloxanes, or combinations of the above (provided that each component of the combination is compatible with each other component).

One embodiment of the present invention uses a xerographic method to imprint a toner formulation onto a material. The toner formulation includes solid particles and binding agents. In addition, the toner formulation can also include, for example, additives, coloring agents, charge control agents (e.g., magnetic and electrostatic), and silicon control agents. The percent composition of the toner can include, for example, 30% solid particles, 60% binding agents, and 10% additives. Another percent composition can include, for example, 20% solid particles, 75% binding agent, and 5% additives. Persons skilled in the art will appreciate that any suitable concentration of toner formulation components can be applied to develop a suitable toner for use with the xerographic imprinting method.

The toner formulation can be produced by a milling process (i.e., mixing solid particles, binding agents, additives, etc.) and an extruding process (i.e., combining the mixture to create the toner formulation). The combined milling and extruding processes provide a toner formulation that has a substantially uniform mixture of the solid particles, binding agents, additives, and any other particles that comprise the toner formulation. Preferably, the milling and extruding processes do not deactivate the solid particles. That is, the binding agents and other particles (e.g., additives) that are mixed with the solid particles do not encapsulate the solid particles during the milling and extruding process. If the solid particles are deactivated, then those solid particles cannot impart the desired performance characteristics.

FIG. 1 shows illustrative xerographic system 100 for implementing a xerographic method to imprint a toner formulation onto a material. Xerographic system 100 includes drum assembly 110 that is charged by charge device 120. Drum assembly 110 can be a cylindrical drum of any diameter and length that rotates at a predetermined speed. Preferably, drum assembly is constructed from a photoconductive material that retains charge. Charge device 120 can charge drum assembly 110 with a positive charge or a negative charge. Charge device 120 can be a wire (e.g., corona wire) that conducts electricity which emits a positive or negative charge to drum assembly 110. In another approach, charge device can be a charged roller that applies charge to drum assembly 110 as it rotates. In yet another approach, an electric current can be applied to drum assembly 110 to provide a desired electric charge. Drum assembly 110 is charged because the xerographic method uses the principle of static electricity transfer the toner formulation to drum assembly 110, which is then transferred to material 155.

After drum assembly 110 is charged, it rotates to developer 130 and receives toner via electrostatic transfer. Developer 130 has several beads 135 that pick up toner from toner hopper 140 as developer 130 rotates. Beads 135 are charged opposite of the toner's charge so that beads 135 can attract toner from toner hopper 140 via electrostatic means. The charge control agents can, for example, provide the desired toner charge. Regardless of how the toner is charged, the toner has a charge opposite to the charge of drum assembly 110. This provides an opposing electrostatic field between drum assembly 110 and the toner on beads 135. Preferably, the charge on drum assembly 110 is stronger than the charge on beads 135. Thus when beads 135 rotate within close proximity of drum assembly 110, the toner transfers from beads 135 to drum assembly 110.

After the toner is applied to drum assembly 110, the toner is transferred from the drum assembly 110 to material 155. The toner may be transferred electrostatically, by friction (i.e., impressing the toner onto material 155 as it passes by drum assembly 110), or by using a combination of both. Material source 150 provides material 155 such as fabric, woven and non-woven material, yarn, etc. Any suitable device can be used to provide material 155 for the xerographic imprinting method. For example, if yarn is being imprinted with the toner, several strands of yarn may be arrayed in a slashing machine prior to xerographic imprinting. If a fabric is being treated in xerographic imprinting system 100, then the fabric may be provided by a ream of such fabric.

One advantage of the present invention is that the application of toner to material 155 is precisely controlled. The control is provided by the electrostatic application of toner to drum assembly 110. Because the toner temporarily attaches to portions of drum assembly 110 that are charged, the toner imprints material 155 in accordance with the charge pattern on drum assembly 110. Thus, the xerographic method imprints the toner on material 155 based on the charge applied to drum assembly 110. Using this approach, xerographic system 100 can imprint toner onto material 155 according to a charge pattern.

If desired, an optional laser system 160 having a laser, a movable mirror, and a lens may be coupled with xerographic system 100. The laser system can be used to form images on drum assembly 110 that are transferred to material 155. An image or pattern may be imprinted onto material 155 as follows. First, drum assembly 110 is uniformly charged by charge device 120. Then the laser system selectively exposes certain areas of drum assembly 110 with light (from the laser). A difference in electrostatic charge density is created between those areas that are exposed to the light and those that are not exposed to the light. Depending on the type of toner formulation applied to beads 135, the toner may attach the areas that were exposed to the light or to the unexposed areas. Then the toner pattern is imprinted onto material 155.

Another advantage of the present invention is that the quantity of the toner imprinted onto material 155 is controllable. The density of the material applied to material 155 can be controlled by limiting the volume of toner picked up by beads 135. For example, if more toner is required, the charge density of beads 135 may be increased to collect more toner particles. Conversely, if less toner is required, the charge density of beads 135 can be decreased.

After the toner is imprinted onto material 155, the imprinted material is subjected to heat so that the binding agents contained within the toner formulation permanently bind the solid particles to material 155. Material 155 may pass through an oven, as shown in FIG. 1, or it may pass through heated drums (e.g., Teflon® coated drums) to set the binding agent. When the binding agent is subjected to heat, it may melt and interconnect a portion of each solid particle to the material. Then when the binding agent cools, it cures and permanently attaches the solid particles to the material. It will be understood that portions of the solid particles may be deactivated when the binding agent attaches it to the material. This partial deactivation, however, is negligible and does not hamper the performance characteristics imparted onto the material.

If desired, a cleaning blade can be used in system 100 to remove any toner formulation that is still attached to drum assembly 110 after that portion of the drum has been impressed on the material. Removing the toner from drum assembly 110 in this manner ensures that the toner is imprinted on the material with consistency and uniform thickness.

The above discussion in connection with FIG. 1 described the xerographic method in context of electrostatic transfer. The xerographic method can also be implemented using magnetic transfer. Instead of using charge control additives, magnetic control additives are used to magnetically transfer the toner to drum assembly 110. Using the xerographic method in a magnetic context, drum assembly 110 is magnetically polarized, instead of electrically charged. The magnetic xerographic method can also image patterns on drum assembly 110 which are applied to material 155 accordingly.

Figure 2:
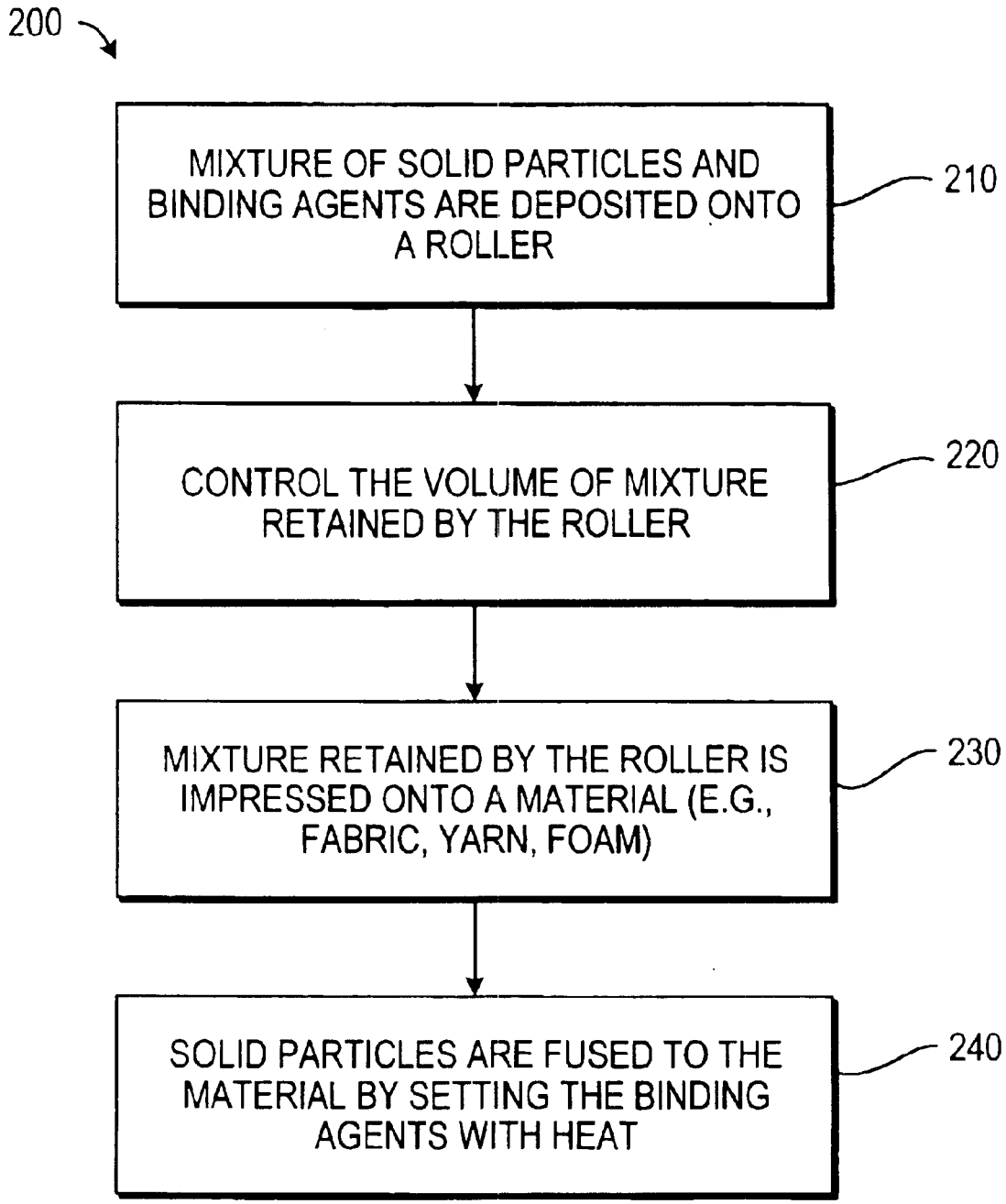
FIG. 2 shows a flow chart for imprinting performance enhancing particles into a material using a Gravure method in accordance with the principles of the present invention.

Another embodiment of the present invention imprints a mixture of solid particles and binding agents to a material using a method that mechanically controls the quantity of the mixture applied to the material. Such a method is referred to as a Gravure method. This mechanical method is illustrated in FIG. 2 as process 200. Starting at step 210, a mixture including the solid particles and the binding agent is deposited into a roller or a drum.

The ratio of the solid particles to the binding agent can vary in any combination by weight. For a given combined weight of the solid particles and the binding agent, the weight of the solid particles can range from about 0% to about 100% of the combined weight. For example, if the mixture comprises 90% solid particles, then the mixture comprises 10% binding agent. Thus, the percent weight of the binding agent is inversely proportional to the percent weight of the solid particles included in the mixture. This mixture does not include additives or charge control agents such as those provided in the toner formulation used in the xerographic method as described above.

The roller that receives the solid particles may have a pattern etched into the surface of the roller. Any suitable pattern may be etched into the surface. The pattern may include, for example, a specific spatial pattern which will be imprinted on a material. If desired, no pattern may be used at all. Such an approach may imprint the mixture in a continuous, square-shaped manner.

At step 220, the volume of the mixture that is to be imprinted on the material is limited by a device such as a doctor blade. This device limits the amount of mixture retained on the roller, thereby limiting the amount of mixture imprinted on the material. Then, at step 230 the mixture is impressed into the material according to the pattern in which the mixture is retained on the roller. The material may pass over or under the roller so that the mixture is impressed therein. If desired, two rollers may be used to impress the mixture into two faces of the material.

At step 240, after the mixture is applied to the material, the material is subjected to heat, which causes the binding agent to fuse the solid particles to the material. An oven such as a convection heat oven or an electric oven can apply heat to the material, thereby fusing the solid particles to the material. An irradiation oven can subject the yarn to heat by irradiating the material with, for example, infrared radiation, ultra-violet radiation, or any other suitable type of radiation. Upon fusion, each solid particle that is permanently attached to the material may be partially encapsulated by the binding agent. While this partial encapsulation is necessary to bind the solid particles to the material, it does not, however, deactivate the entire solid particle. Rather, only a portion of the solid particle is deactivated and the rest of the solid particle remains active. Thus, the fused solid particles are able to impart the desired performance characteristics to the material, even while being partially encapsulated.

Using the above-mentioned imprinting methods, the performance characteristics of various materials are enhanced. Various applications that benefit from the imprinting methods of the present invention include, for example, upholstery, carpeting, rugs, mats, linins, sheets, towels, rags, pet beds, mattress pads, curtains, shoes, insoles, and diapers. The treated materials can also be used in clothing such as shirts, pants, blouses, undergarments (e.g., t-shirts, underwear, bras, etc.), hats, and other clothing related items. Protective suits such as bio-chemical protective suits can be constructed using the treated material. In addition, hunting gear can be constructed using the imprinted materials of the present invention. Moreover, filters can be constructed with the imprinted materials. Such filters can be used in vacuum cleaners to trap pollen and other particles. The filters can be used in laboratories using hazardous biological materials; the solid particles in the material may entrap the biological agents and prevent them from escaping into the atmosphere.

The imprinting methods of the present invention can be used to apply a limited volume of solid particles to particular sections of clothing. For example, activated carbon can be impressed into the crotch area of briefs or panties. By precisely limiting the application of the activated carbon, such briefs or panties would be comfortable to wear and adsorb bodily odors. If desired, the imprinting methods can be used to imprint solid particles (e.g., activated carbon) onto a material that is used as an insert (e.g., pad) which can be sewn into strategic areas of clothing (e.g., armpit areas). In another approach, imprinting method can be used to imprint solid particles (e.g., activated carbon) into the insole of shoes.

Persons skilled in the art will appreciate that the above-mentioned applications for the imprinted materials of the present invention is not an exhaustive list, but merely an exemplary description of the possible applications.

The following examples provide illustrative examples on how the present invention can be used to obtain materials having solid particles imprinted thereon using the methods described above. These examples are for the purpose of illustration only and are not to be construed as limiting the scope of the invention in any way.

EXAMPLE 1

This example was performed using a xerographic system similar to the xerographic system depicted in FIG. 1. Raven Industries of Latrobe, Pa. produced an OptraS toner clone using 30% activated carbon for use in the toner formulation. The activated carbon is sold as NORTIT SX-4 Ultra by NORIT America Company of Atlanta, Ga. The activated carbon substituted the carbon black from Raven's OptraS formulation. The toner formuation was milled and prepared for use in a Lexmark OptraS laser printer. Gray scale and all black prints were imprinted on a 3 oz/sq yard woven cotton fabric. The woven cotton fabric in this example is sold by Alice Mills Company of Easley, S.C. After the toner formulation was fused to the cotton fabric, the carbon activity was tested using the ASTM D 5742-95 method. The ASTM method saturates the fabric with butane gas, then measures the saturated fabric to determine mass pick up. It was found that 13 $g/m^2$ of SX-4 Ultra was active on the woven fabric with an all black print darkness setting of 7.

EXAMPLE 2

This example used the same setup as described in Example 1, except the toner formulation included 20% activated carbon rather than 30% activated carbon. After the toner formulation was imprinted onto the cotton fabric, the carbon activity was tested using the ASTM D 5742-95 method. It was found that 9 $g/m^2$ of SX-4 Ultra was active on the woven fabric with an all black print darkness setting of 7.

Thus it is seen that processes for imprinting solid particles onto a material to enhance the performance characteristics of the material are provided. A person skilled in the art will appreciate that the present invention can be practiced by other than the described embodiments, which are presented for purposes of illustration rather than of limitation, and the present invention is limited only by the claims which follow.

What is claimed is:

1. A method for producing a performance enhanced material, comprising:

xerographically transferring a toner formulation to a drum assembly, the toner formulation comprising:

activated carbon having an adsorptive capacity; and a binding agent;

imprinting the toner formulation onto the material via the drum assembly; and fusing the activated carbon to the material with the binding agent such that the activated carbon bound thereto imparts its adsorptive capacity to the material.

2. The method according to claim 1, wherein said activated carbon imparts properties selected from the group consisting of odor-adsorption, moisture management, ultraviolet light protection, thermal insulation, thermal regulation, antiviral protection, antibacterial protection, antifungal protection, antimicrobial protection, fire protection, chemical agent protection, infrared light protection, and any combination thereof.

3. The method according to claim 1, further comprising preparing the toner formulation by:

milling the activated carbon and the binding agent; and extruding the toner formulation from the milled activated carbon and binding agent.

4. The method according to claim 1, wherein the transferring comprises electrostatically transferring the toner formulation to the drum assembly.

5. The method according to claim 1, wherein the transferring comprises magnetically transferring the toner formulation to the drum assembly.

6. The method according to claim 1, wherein the transferring comprises applying the toner formulation in a pattern onto the drum assembly.

7. The method according to claim 6, wherein the pattern is imprinted onto the material.

8. The method according to claim 1, wherein the fusing comprises subjecting the material and the impressed toner formulation to an elevated temperature that causes the binding agent to attach the activated carbon to the material.

9. The method according to claim 1, wherein the binding agent is selected from the group consisting of natural rubber latex, NEOPRENE, styrene butadiene, acrylic/acrylonitrile copolymer, modified n-butyl acrylonitrile copolymer, acrylonitrile polyvinyl acetate, polyacrylate, acrylonitrile butadiene, acrylic methyl methacrylate, self cross-linking copolymers of vinyl acetate, self cross-linking copolymers of ethylene, polystyrenes, polyesters, polyvinyl alcohol, polyvinyl acetate, vinyl chloride copolymers, melamine-formaldehyde resins, starches, carboxymethyl cellulose, methyl cellulose, sodium silicate, and siloxanes, including functionalized saloxanes, and any combination thereof.

10. The method of claim 1, wherein the toner comprises a plurality of additives selected from the group consisting of charge control additives, electrostatic charge control additives, magnetic charge control additives, silicon control additives, coloring additives, and any combination thereof.

11. A woven material having the activated carbon embedded therein according to the method of claim 1.

12. A non-woven material having the activated carbon embedded therein according to the method of claim 1.

13. A yarn having the activated carbon embedded therein according to the method of claim 1.

14. A foam having the activated carbon embedded therein according to the method of claim 1.

15. A knitted material having the activated carbon embedded therein according to the method of claim 1.

* * * * *